United States Patent [19]

Nissen

[11] Patent Number: 4,712,986

[45] Date of Patent: Dec. 15, 1987

[54] OIL FEEDING APPARATUS FOR A ROTARY COMPRESSOR

[75] Inventor: Harry S. Nissen, Sonderborg, Denmark

[73] Assignee: Danfoss A/S, Nørdborg, Denmark

[21] Appl. No.: 894,580

[22] Filed: Aug. 8, 1986

[30] Foreign Application Priority Data

Aug. 13, 1985 [DE] Fed. Rep. of Germany ..... 3528963

[51] Int. Cl.[4] ..... F04C 29/02

[52] U.S. Cl. ..... 418/63; 418/88; 418/94

[58] Field of Search ..... 418/88, 63, 94

[56] References Cited

U.S. PATENT DOCUMENTS 2,177,731 9/1937 Long et al. ..... 417/151

FOREIGN PATENT DOCUMENTS 57-020584 2/1982 Japan ..... 418/88

58-065993 4/1983 Japan ..... 418/88

59-165887 9/1984 Japan ..... 418/88

59-226295 12/1984 Japan ..... 418/88

59-226294 12/1984 Japan ..... 418/88

*Primary Examiner*—John J. Vrablik

*Assistant Examiner*—Eugene L. Szczecina, Jr.

*Attorney, Agent, or Firm*—Wayne B. Easton; Clayton R. Johnson

[57] ABSTRACT

The invention relates to a rotary compressor assembly of the type in which an electric motor and a rotary compressor are mounted in a seal capsule and share a common drive shaft. A lubricant storage chamber is formed in the housing adjacent the outboard bearing of the compressor and auxiliary pumping apparatus which includes a conduit equipped with a venturi passage provided for conveying lubricating oil from the pump to the storage chamber. Mechanical apparatus associated with the shaft conveys oil from the storage chamber to the shaft bearings.

5 Claims, 7 Drawing Figures

OIL FEEDING APPARATUS FOR A ROTARY COMPRESSOR

The invention relates to an oil feeding apparatus for a rotary compressor which comprises a rolling piston driven by a horizontal shaft and running eccentrically in a cylinder fixed with respect to the housing and a vane that is pressed against the rolling piston and is therefore radially reciprocated thereby and that separates the suction and pressure chambers of the compressor from each other, and which is disposed in a capsule having an oil sump, the vane projecting into a pump chamber to serve as a pump piston and an oil feeding conduit being connected to the pump chamber and having a suction orifice near this pump chamber within the oil sump.

In a known oil feeding apparatus of this kind (GB-PS No. 20 29 507), the oil feeding conduit consists of a cylindrical oil feeding tube which is inserted in a side plate of the housing of the pump chamber and has the suction orifice at a small spacing from this bore. The oil feeding tube feeds into a bore of the horizontal shaft. From there, the oil is distributed to the lubricating points of the rotary compressor and the associated electric motor.

On the pressure stroke the oil pump feeds oil through the oil feeding conduit, an ejector effect being created at the suction orifice, as a result of which a small amount of oil is also carried along out of the sump. On the suction stroke, part of the oil is sucked out of the oil sump through the suction orifice but a considerable proportion of the oil contained in the oil feeding tube is also sucked back. Consequently, the efficiency of the pump is limited.

It is the problem of the invention to provide an oil feeding apparatus of the aforementioned kind having a better efficiency.

This problem is solved according to the invention in that the oil feeding conduit comprises a venturi passage of which the largest cross-section is adjacent to the pump chamber, has the suction orifice in the region of the smallest cross-section and, substantially with this smallest cross-section, opens into a conduit section of larger cross-section.

In this construction, the use of the venturi passage and the position of the suction orifice ensure that, during the suction stroke, a larger amount of oil is sucked out of the sump and carried along in the feeding direction. On the suction stroke, a substantially larger amount of oil than hitherto is sucked out of the sump because the oil in the oil feeding conduit is subjected to a larger resistance to flowing back. This resistance is brought about by the fact that the conduit cross-section changes considerably in the region of the mouth of the venturi passage. The returning oil must enter the narrow cross-section of the mouth of the venturi passage from a conduit section of larger cross-section. This creates considerable eddying. The suction of oil out of the sump is therefore improved on the pressure as well as the suction stroke and consequently the efficiency is increased.

In one embodiment, the initial section of the feeding conduit is formed by a tube containing an insert having a venturi passage. Only the insert has to be machined. Otherwise, a throughgoing oil feeding tube can be employed.

In another embodiment, the venturi passage is tubular and merges in one piece with a step-like enlargement in an oil feeding tube. Such an oil feeding conduit is readily manipulated.

In a third embodiment, the venturi passage has a tubular mouth section on which the initial section of an oil feeding tube is placed. This results in a particularly simple construction for the cross-sectional enlargement.

In particular, the oil feeding tube may have an enlarged cross-section in the region of the mouth. Since the mouth projects into the cross-sectional enlargement, eddying is still more intensive and hence sucking back of the oil in the oil feeding conduit is reduced still further.

A further improvement is obtained in that the suction orifice is preceded by a suction funnel projecting into the oil sump.

In a preferred embodiment, the cylinder fixed with respect to the housing is formed by a disc which also bounds the pump chamber and against both sides of which there lie the side plates covering the cylinder bore. The pump chamber is closed at both sides by smaller cover plates, one of which projects into the venturi passage. This results in a particularly good connection of the venturi passage. In addition, the side plates can be formed independently of the cover of the pump chamber and in particular they may be rotationally symmetric, which facilitates production, especially if the side plates are made in one piece with shaft bearings.

The one cover plate should have a bulge in the region of the largest cross-section of the venturi passage. In front of the entrance to the venturi passage, there will then be a free space to which the oil can flow freely on the pressure stroke.

In particular, the one cover may be made in one piece with the adjoining portion of the oil feeding conduit. This results in a particularly good connection of the venturi passage. For example, the cover plate may be a part moulded from plastics material.

Another good connecting possibility is for the venturi passage to be formed by a tube which is enlarged on the inlet side and for the enlargement to lie against the inside of the bulge.

Further simplification in manufacture is obtained if both cover plates are interconnected by screws.

Preferred examples of the invention will now be described in more detail with reference to the drawing, wherein.

Figure 2:
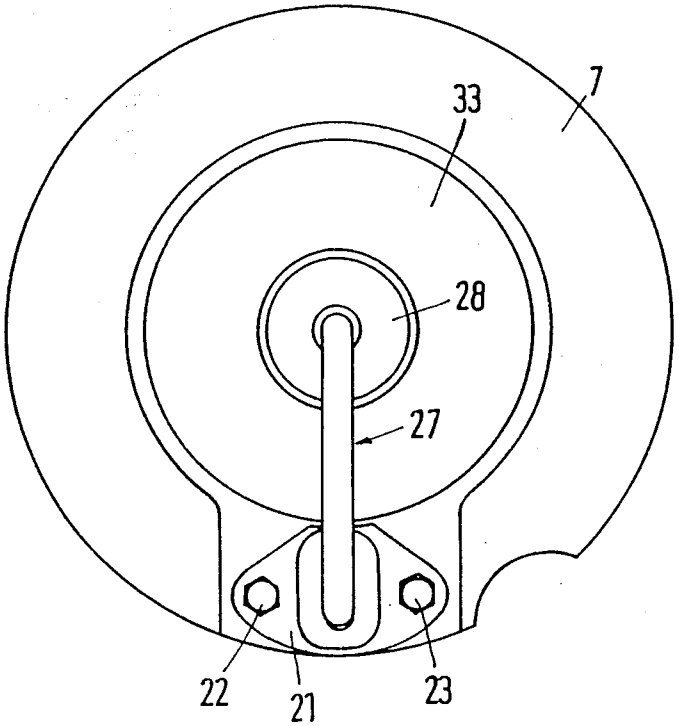
FIG. 2 is an end elevation of the rotary compressor within the capsule.
Figure 1:
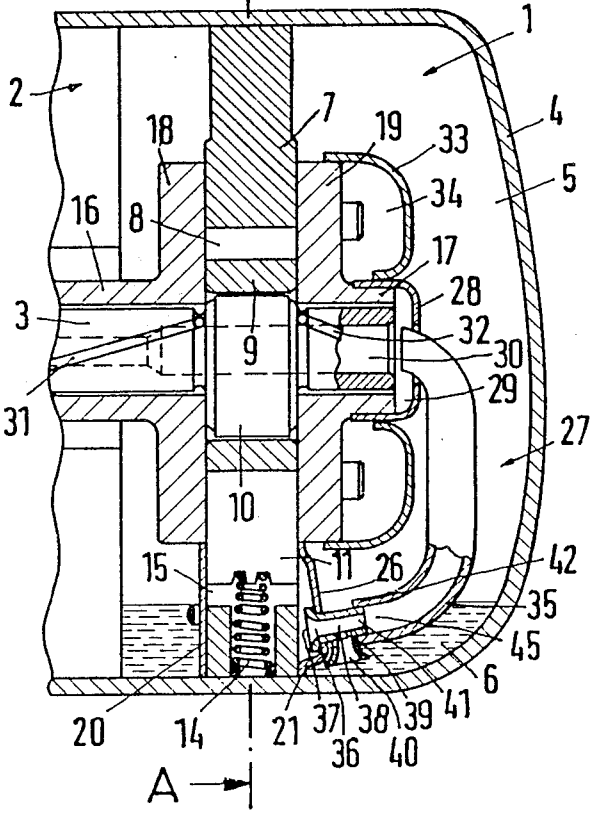
FIG. 1 shows an oil feeding apparatus according to the invention for a rotary compressor.
Figure 3:
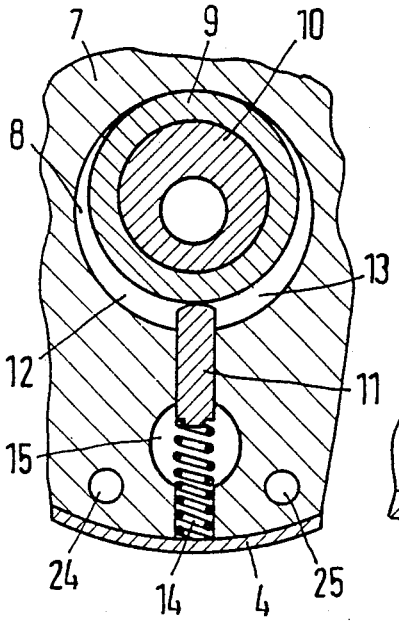
FIG. 3 is a partial cross-section on the line A—A in FIG. 1.

In FIGS. 1 to 3, a rotary compressor 1 driven by a diagramatically indicated electric motor 2 by way of a horizontal shaft 3 is accommodated in a capsule 4 of which the interior 5 has an oil sump 6. A cylinder 7 in the form of a disc is circumferentially pressed into the capsule 4 or welded therein. In a cylinder bore 8 it has a rolling piston 9 which is in the form of a ring and is driven on an excentric track by an excentric 10 of the drive shaft 3.

A vane 11 is radially displaceable in the disc-like cylinder 7. It lies against the rolling piston 9 and separates each suction chamber 12 from the pressure chamber 13. The vane is loaded by a spring 14 and its other end projects into a pump chamber 15.

At both sides of the cylinder 7 there is a respective shaft bearing 16 and 17. The shaft bearings are connected in one piece with rotationally symmetrical side plates 18 or 19 which cover the cylinder bore 8 and, between each other and the rolling piston 9, leave a small space of, for example, 0.01 mm. This space is also in the region of the vane 11. The pump chamber 15 is closed on both sides by smaller cover plates 20 and 21 which are connected to each other and to the cylinder with the aid of screws 22 and 23 engaging through holes 24 and 25 in the cylinder 7. The cover plate 21 has a bulge 26 from which an oil feeding conduit 27 extends. The latter leads to a cavity 29 which is formed by a sheet metal attachment 28 at the end of the shaft 3. The oil fed to this position can be fed through a bore 30 of the shaft 3 to the individual lubricating points of the compressor and of the electric motor. Feeding can be assisted by spiral grooves 31 and 32 which are in communication with the central bore 30 through radial bores. A sheet metal ring 33 at the side plate 19 bounds a sound damping chamber 34.

Over most of its length, the oil feeding conduit 27 comprises an oil feeding tube 35 but is provided between this tube and the pump chamber 15 with a venturi passage 36 of which the largest cross-section 37 is adjacent to the pump chamber 15. In the region of the smallest cross-section 38, there is a suction orifice 39 with a preceding suction funnel 40. The venturi passage is tubular. The tube material is enlarged on the side of the pump chamber 15. The enlargement lies against the inside of the bulge 26. The initial section 42 of the oil feeding tube 35 is placed over the mouth section 41 of the venturi passage 36. Consequently, a zone 45 is formed at this position that has a sudden enlargement in cross-section.

In operation, the vane 11 is continuously moved up and down. During downward motion, a pressure stroke is obtained at which the oil is pressed through the venturi passage 36 into the oil feeding tube 35. An ejector effect is set up at the suction orifice 39, as a result of which oil is carried along out of the sump 6. During upward motion of the vane 11, a suction stroke takes place. It causes oil to be sucked out of the sump 6 into the pump chamber 15. Simultaneously, oil is sucked back out of the oil feeding tube 35. By reason of the sudden change in cross-section in the region of the mouth 41, eddying is set up to counteract such sucking back. Consequently, the oil feeding apparatus has a high efficiency.

Figure 4:
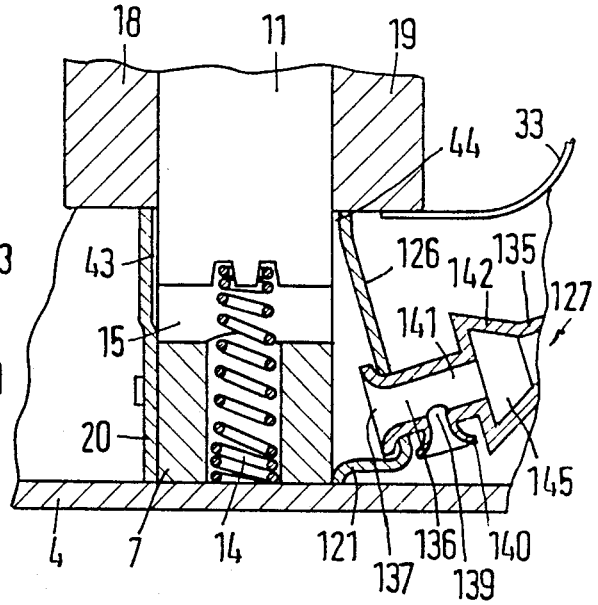
FIG. 4 is a partial longitudinal section through another embodiment of the oil feeding apparatus.

In the FIG. 4 embodiment, the same parts as in FIGS. 1 to 3 are given reference numerals increased by 100. The enlarged view shows more clearly that the cover plates 20 and 21 have more play 43 or 44 in relation to the vane 11 than do the side plates 18 and 19, for example 0.15 mm. Comparatively coarse material can therefore be employed by the side plates 20 and 21.

The oil feeding conduit 127 is here made entirely in one piece. The venturi passage 136 with the largest cross-section 137 formed by an enlargement as well as the suction orifice 139 and the suction funnel 140 has its mouth 141 communicating directly with an enlarged section 142 of the oil feeding tube 135 so that the venturi passage 136 opens into a conduit section 145 of larger cross-section.

Figure 5:
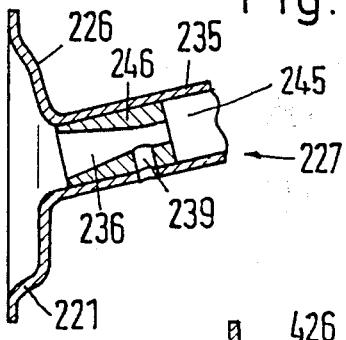
FIG. 5 is a partial cross-section through a further embodiment of the oil feeding apparatus.

In the FIG. 5 embodiment, components corresponding to those of FIGS. 1 to 3 carry reference numerals increased by 200. An insert 246 containing the venturi passage 236 and the suction orifice 239 is inserted in the oil feeding tube 235 which is made in one piece with the bulge 226 of the cover plate 221. At the end of the insert, there is again a zone 245 of larger cross-section.

Figure 6:
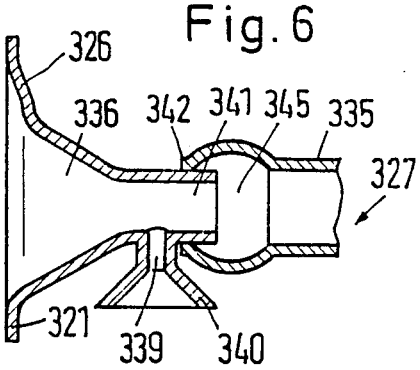
FIG. 6 is a partial longitudinal section through a further embodiment of the oil feeding apparatus.

Components corresponding to those in FIGS. 1 to 3 are given reference numerals increased by 300 in the embodiment of FIG. 6. The venturi passage 336 is made in one piece with the cover plate 321, the suction orifice 339 and the suction funnel 340. An enlarged section 345 of the oil feeding tube 335 is pushed over the mouth section 341. The mouth 341 projects into this enlargement so that even more intensive eddying is created when the oil is sucked back.

Figure 7:
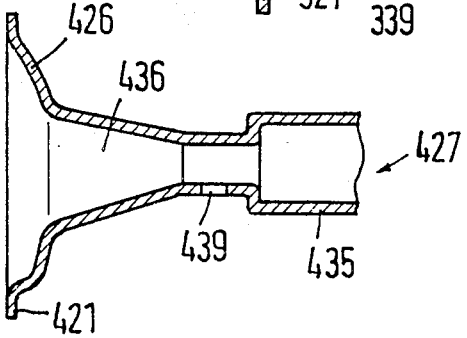
FIG. 7 is a partial longitudinal section through yet another embodiment of the oil feeding apparatus.

In the FIG. 7 embodiment, parts corresponding to those in FIGS. 1 to 3 have reference numerals increased by 400. In this case, the cover plate 421, the venturi passage 436 with its suction orifice 439 and the adjoining oil feeding tube 435 are made in one piece.

The individual moulded parts can be of plastics material, for example in that two hollow segmental moulded parts are welded together.

I claim:

1. A rotary compressor assembly, comprising a capsule having a lower part forming an oil sump, and an electric motor and a rotary compressor mounted in the capsule, the rotary compressor including a horizontal shaft driven by said motor, a housing having a rotary piston bore, at least in part defining a pump chamber that has a closed axial side and an opposite open axial side, and mounting the shaft for rotation, a rolling piston eccentrically mounted on the shaft, a vane mounted in the pump chamber, resiliently retained in engagement with the rolling piston to separate the housing bore into suction and pressure chambers, and reciprocably movable in the pump chamber to operate as a pump piston, an oil feeding conduit having a first end joined to and opening to the housing adjacent to the shaft and a second end adjacent to the sump, a venturi passage assembly having a first end joined to the conduit second end, said venturi passage assembly having an opposite second end, a venturi passage extending between the venturi assembly ends and in part is defined by a tapered bore portion convergingly, the bore portion having a larger cross sectional end more closely adjacent to the venturi assembly second end than the venturi assembly first end and a smaller cross section end that is more closely adjacent to the venturi assembly first end than the venturi assembly second end and an orifice opening to the venturi passage more closely adjacent to the bore portion smaller cross section end than the bore portion larger cross sectional end for placing the venturi passage in liquid communication with the oil sump to draw oil from the sump when oil flows from the pump chamber toward the conduit, the conduit having a passage in the second end that opens to the venturi passage and adjacent to the venturi passage is of a substantially larger cross section than the bore portion smaller cross section, and a side plate for closing the pump chamber opposite side and joined to the venturi assembly second end for placing the venturi second end in liquid communication with the pump chamber.

2. A rotor compressor assembly according to claim 1 wherein the cross-section of said oil feeding conduit increases downstream from said venturi passage assembly.

3. A rotor compressor assembly according to claim 1 wherein said venturi passage assembly includes an insert forming a venturi passage.

4. A rotary compressor assembly according to claim 1 wherein the housing includes a disk having the housing bore and a radial cut out that in part defines the pump chamber, and a second side plate closing one side of the pump chamber, and that the first side plate is joined to the disk and has a portion bulged out from the disk and through which the venturi assembly second end opens to the pump chamber.

5. A roary compressor assembly according to claim 1 wherein the venturi assembly includes a funnel shaped portion that has a reduce diameter end opening to said orifice and an enlarged diameter end opening to the sump.

* * * * *